United States Patent [19]

Yates

[11] 4,004,482

[45] Jan. 25, 1977

[54] METHOD OF TUNING FRETTED INSTRUMENTS

[76] Inventor: Jeffery L. Yates, 3304 Owl Drive, Rolling Meadows, Ill. 60008

[22] Filed: Sept. 25, 1975

[21] Appl. No.: 616,851

[52] U.S. Cl. ..... 84/455; 84/457

[51] Int. Cl.[2] ..... G10G 7/02

[58] Field of Search ..... 84/454–458

[56] References Cited

UNITED STATES PATENTS 890,803 6/1908 Severy et al. ..... 84/455 X

*Primary Examiner*—Lawrence R. Franklin

*Attorney, Agent, or Firm*—Frank R. Thienpont

[57] ABSTRACT

A method for tuning a fretted string instrument such, for example, as a guitar, by the use of a tuning fork of predetermined pitch by positioning a vibrating tuning fork on the string to be tuned and then adjusting the tension of the string until the vibrating tuning fork causes an audible sympathetic resonance of the string when the tuning fork is at a position where the pitch of the tuning fork and pitch of the string (as determined by the fret scale of the instrument) coincide.

6 Claims, 4 Drawing Figures

20
22
24
26
F
1
2
3
4
5
6
7
8
9
10
11
12
F 349.2 Hz
F#369.99 Hz
G 391.99 Hz
G# 415.3 Hz
A 440 Hz
A#466.2 Hz
B 493.9 Hz
C 523.25 Hz
G# 207.652 Hz
A 220 Hz
A#233.082 Hz
B 246.942 Hz
C 261.626 Hz
PITCH OF FRETTED NOTES ALONG STRING
PITCH OF FRETTED NOTES ALONG STRING

METHOD OF TUNING FRETTED INSTRUMENTS

BACKGROUND OF THE INVENTION

This invention relates to a method for tuning a string on a fretted instrument to a predetermined standard by introducing a known pitch at a given point or points along the string.

The number of players of fretted instruments was, until recent years, rather small, and these players tended to tune their instruments to accommodate their particular singing voices, rather than to commonly accepted standards of pitch employed by other musicians, such as in an orchestra. However, in recent years the number of people playing, or attempting to play, fretted instruments has risen dramatically (in particular, on such instruments as the guitar and banjo) and these instruments have come out of the "folk" realm, and into the realm of serious musical study wherein the player of fretted instruments finds it necessary to tune to commonly accepted standards of pitch as they often times find themselves playing with ensembles of other musicians wherein it is necessary that all members of the ensemble tune to a common standard of pitch. Further, the development of fretted instruments by manufacturers who have found their markets rapidly expanding, has been such that each fretted instrument is designed to produce optimum tonality when the instrument is tuned to commonly accepted standards of pitch predetermined for the instrument.

In short, there are millions of players of fretted instruments today seriously undertaking the study of music on instruments scientifically designed to perform at their optimum tonality when they are tuned to commonly accepted standards of pitch. Thus the evident need for a simple and accurate method of tuning fretted instruments which is easily accomplished by the many people who now play these instruments, since these players are the ultimate tuners of their instruments.

There are several methods and/or devices currently in use to accomplish the task of tuning fretted instruments. All of these have certain disadvantages. All but one of the following methods and/or devices fall into the category of relative tuning methods. That is, they require the tuner to make a comparison and determine by use of the ear when the pitches of two notes are identical. Common practice has shown this approach to be highly inaccurate for these reasons:

1. There is no guarantee that the tuner can accurately determine by use of the ear when the pitches of two notes are identical. Indeed, the overwhelming majority of tuners cannot.

2. Even if the tuner can accurately determine when the pitches of two notes are identical, there is no guarantee with these methods and/or devices that the pitch of the note being used as a standard to tune to is entirely accurate. Therefore, even if this serious limitation (No. 1, above) is overcome, it is still very conceivable that the tuner will tune inaccurately.

3. Very few people are blessed with what is known as "perfect pitch", the ability to determine accurately by use of the ear the pitch of a given note or notes. However, even this ability fluctuates greatly with atmospheric conditions and the physical health of the tuner (such as a common cold, allergic reaction, etc.), leaving this person with all too frequent periods when tuning accurately is not possible.

One method uses the piano as a device for tuning fretted instruments. The desired pitch of the open string(s) (an "open" string on a fretted instrument is that length of string which is said to have a speaking voice equal to the distance between the nut and bridge of the instrument) of the fretted instrument is determined via commonly accepted standards, and the corresponding key(s) (that key which, when sounded, will produce this predetermined pitch) of the piano keyboard is selected. The tuner then strikes the designated key(s) of the piano to sound the pitch of the note to be tuned to, then sounds the open string(s) of the fretted instrument, discerning by use of the ear any discrepancy between the pitches of the two notes thus sounded. By means of the tuning keys of the fretted instrument, the tuner then proceeds to adjust the tension of the open string of the fretted instrument until, by use of the ear, the tuner is satisfied that the pitches of the two notes are identical.

An advantage of this method is that the piano, because its strings are not touched by the hands, tends to stay in tune to proper pitch for greater lengths of time than do fretted instruments.

One disadvantage of this method is that there is absolutely no guarantee that the tuner can accurately determine by ear when the pitches of the two notes are identical. Furthermore, there is no guarantee that the pitch of the note sounded on the piano (the pitch being used as a standard to tune to) is accurate, as it is commonly known that pianos need periodic retuning to keep them at proper pitch.

Most notable, of course, is the fact that a piano, not being portable, is not always present when the tuner of fretted instruments needs to tune.

Another method available to tune fretted instruments is by use of a pitch pipe. The tuner sounds the pitch pipe by blowing upon that reed of the pitch pipe which is designated for the open string on the fretted instrument which he wishes to tune. Then he sounds the open string of the fretted instrument, discerning by use of the ear any discrepancy between the pitches of the two notes thus sounded. By means of the tuning keys of the fretted instrument, the tuner then proceeds to adjust the tension of the open string of the fretted instrument until, by use of the ear, the tuner is satisfied that the pitches of the two notes are identical.

While the pitch pipe is a small device which is portable and tends to hold very well the pitch to which it was originally tuned, it has limitations. Here again there is absolutely no guarantee that the tuner can accurately determine by ear when the pitches of the two notes are identical. Furthermore, there is no guarantee that the pitch of the note sounded on the pitch pipe is accurate, as blowing too hard or too softly into the pitch pipe will distort its pitch.

Fretted insstruments are also tuned by using other fretted instruments. The tuner uses one fretted instrument as a standard and tunes another fretted instrument to it by sounding the open pitch of one of the strings of the instrument being used as a standard (or some fretted note along one of the strings known to be identical to the pitch of the open string he is tuning) then sounding the open string of the instrument to be tuned, again determining by ear any discrepancy between the pitches of the two notes thus sounded. The tuner then proceeds to adjust the tension of the open string of this instrument until, by use of the ear, the tuner is satisfied that the pitches of the two notes are identical. Here again, there is no guarantee that the tuner can accurately determine by ear when the pitches of the two notes are identical. Also, there is no guarantee that the pitch of the note sounded on the instrument being used as a standard is accurate, as it was most likely tuned by one or more of the methods being described, and fretted instruments are notorious for going out of tune. Furthermore, the tuner does not always have access to an extra fretted instrument to use as a standard.

Another method uses a tuning fork as a standard. This method, however, does not utilize the principles of the invention herein. In this method the tuner selects a tuning fork known to be the same pitch as standard for one of the open strings of his instrument or some note fretted along one of the strings and strikes it or otherwise excites it to motion. It is then placed on some solid surface, which serves to amplify the pitch of the tuning fork. The tuner then strikes the open (or fretted) string of the instrument to be tuned, discerning by use of the ear any discrepancy between the pitches of the two notes thus sounded. By means of the tuning key of the fretted instrument, the tuner then proceeds to adjust the tension of the open (or fretted) string of the fretted instrument until, by use of the ear, the tuner is satisfied that the pitches of the two notes are identical.

In this method there is absolutely no guarantee that the tuner can accurately determine by ear when the pitches of the two notes are identical. Furthermore, this procedure allows for the tuning of one string of the fretted instrument only, and the tuner must then proceed to use other methods to complete the tuning of the instrument. For example, the tuner may proceed to match pitches of fretted notes with pitches of open strings. The tuner, by means of some device such as those mentioned thus far, or by his own random determination, considers one string of the instrument to be tuned to be accurate. This string is then fretted at a point along it which gives rise to the pitch of another string on the instrument (and usually adjacent to it). The fretted string is sounded, then the open string which is to be tuned is sounded, and the tuner determines by ear any discrepancy between the pitches of the two notes thus sounded. The tuner then proceeds to adjust the tension of the open string of the instrument until, by use of the ear, the tuner is satisfied that the pitches of the two notes are identical. The tuner then repeats this process, using the string just tuned to tune another open string. The process is thus repeated as many times as necessary to tune all the strings of the instrument.

Here again, there is no guarantee that the tuner can accurately determine by ear when the pitches of the two notes are identical. In addition, there is no guarantee that the string being used as a standard to begin this process is accurately tuned to pitch. Furthermore, since the note being sounded as a standard (the fretted note to which the open string is tuned) is a fretted note, it will not sustain because the tuner has to release it, causing it to fall silent, in order to adjust the tension of the string being tuned via the tuning key of the instrument. The tuner may also match pitches of harmonic notes on one string to harmonic notes on another string. The tuner, by means of some device such as those mentioned thus far, or by his own random determination, considers one string of the instrument to be accurately tuned to proper pitch. This string is then sounded harmonically at a point along it which gives rise to a pitch which is readily sounded harmonically on another (and usually adjacent) string. Then the string to be tuned is sounded harmonically at a point which should coincide with the pitch of the harmonic of the string being used as a standard, and the tuner determines by ear any discrepancy between the pitches of the two notes thus sounded. By means of the tuning key of the string being tuned, the tuner then proceeds to adjust the tension of this string until, by use of the ear, the tuner is satisfied that the pitches of the two notes are identical. This process is then repeated at other harmonic points on other strings, until the instrument is considered to be in tune.

Here again, there is no guarantee that the tuner can distinguish accurately by ear when the pitches of the two notes are identical, or that the string being used as a standard to begin this process is accurately tuned to pitch. In addition, certain strings on fretted instruments do not have easily attainable harmonics which can be played on other strings, thus leaving the inevitability that one or more strings on the fretted instrument being tuned will have to be tuned with some other process. Also, the concept of playing harmonically is beyond the grasp of the average beginning player of fretted instruments, leaving this method not usable until they have attained a particular facility with their instrument and understanding of its fingerboard notes and their overtones.

Another method makes use of a device known as an Accu-Tuner device which the tuner plugs into an amplifier. It produces one of two pitches, E 329.6 Hz, or A 440 Hz, in a steady, uninterrupted sequence. The tuner then selects an open string (or a fret location along a string) which coincides with the frequency being given off by the device (or a similar frequency one or two octaves higher or lower) and sounds it. Then the tuner determines by ear any discrepancy in the pitches of the two notes thus sounded. By means of the tuning key of the string being tuned, the tuner then proceeds to adjust the tension of this string until, by use of the ear, the tuner is satisfied that the pitches of the two notes are identical. Tuning the rest of the strings of the instrument is then accomplished by one or more of the aforementioned methods.

While this device gives off an accurate, uninterrupted tone by which the tuner may establish a standard, its use also has certain limitations. Again, there is no guarantee that the tuner can accurately determine by ear when the pitches of the two notes are identical. As mentioned, the device is not self sufficient in that it provides a means whereby only one string may be tuned if the tuner can accurately distinguish pitches by ear. In order to complete the tuning, the tuner must work within the limitations of one of the aforementioned methods. If the tuner does not have ready access to an amplifier or to an electrical power source, the device is not usable.

Sometimes recordings are used as a standard, but these also present obvious disadvantages not the least of which is lack of access to a record player when needed.

Thus, it is seen that the above-described methods of tuning all have deficiencies. Accordingly it becomes desirable to simplify the method of tuning a fretted string instrument while at the same time providing accuracy in tuning strings to the desired pitch.

SUMMARY OF THE INVENTION

It is an object of the present invention therefore to provide a method of tuning a fretted string instrument whereby the tuning is scientifically accurate and independent of the tuner's ear, the tuner not being required to rely on his own sense of pitch.

Another object of the invention is to provide a method of tuning which is applicable to substantially all fretted string instruments.

Another object of the invention is to provide a convenient method of tuning a fretted string instrument using only a tuning fork and thereby avoiding the necessity of other accessories which may not be readily available.

Other objects and advantages of this invention will become more apparent when considering the following description and accompanying drawings.

DESCRIPTION OF THE PREFERRED EMBODIMENT

Figures 1, 2, 3, 4:
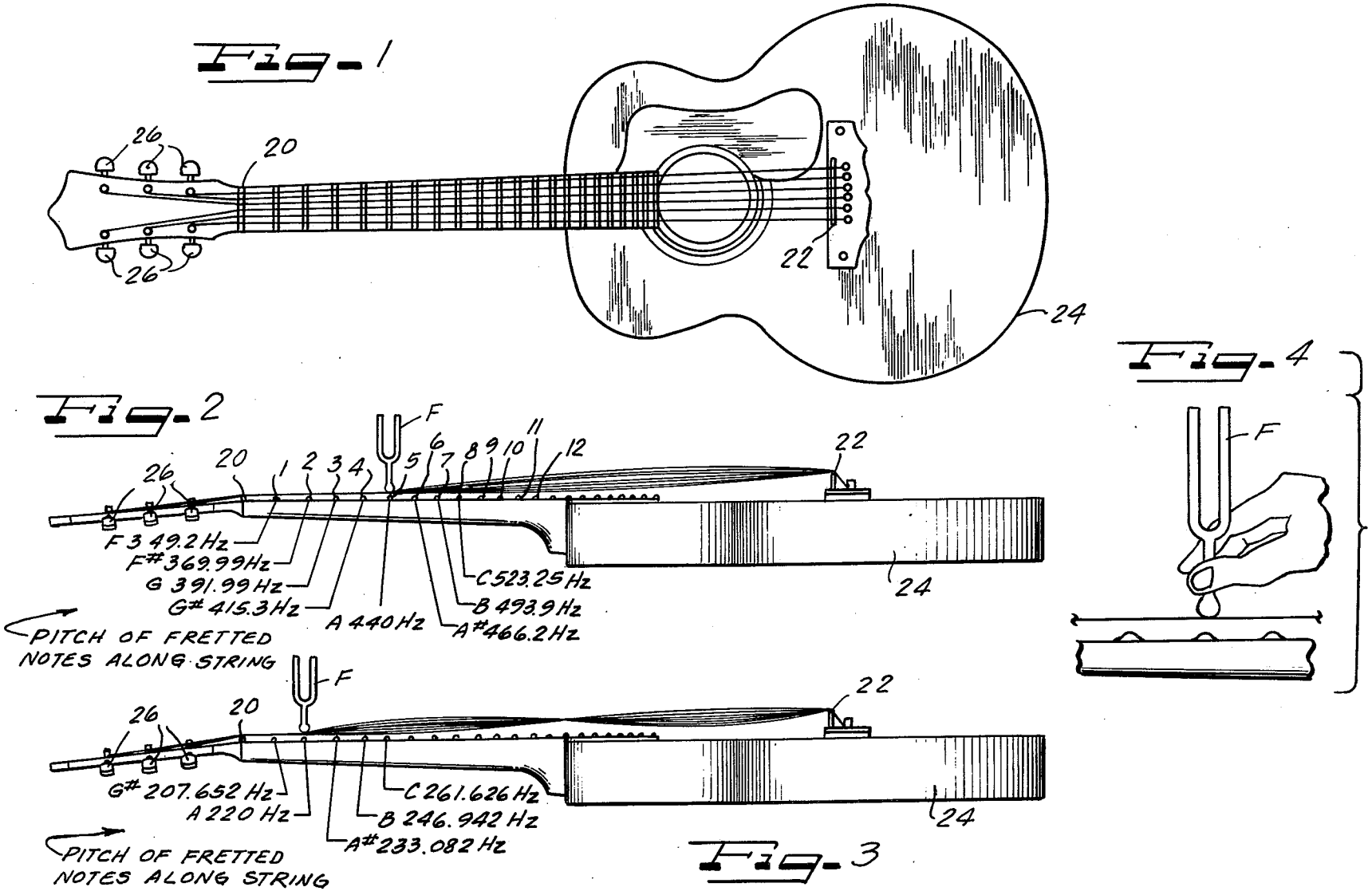
FIG. 1 is a plan view of a typical six string guitar.
FIG. 2 is an elevation view of the guitar of FIG. 1 showing the first string vibrating in sympathetic resonance with a vibrating tuning fork.
FIG. 3 is an elevation view of the guitar of FIG. 1 showing multiple segments of the third string in sympathetic resonance with a vibrating tuning fork.
FIG. 4 is an enlarged view in elevation showing how a tuning fork is held on a string to be tuned.

The method of tuning to which this invention relates utilizes a simple tuning fork which is excited to motion and placed in contact with the string to be tuned.

The pitch of the open string is predetermined and is known through common and accepted standards for the instrument. The pitch of any given note along the open string is predetermined by the fret scale of the instrument and also is known through common and accepted standards for the instrument.

The string shown in FIG. 2 is the first string of a classic guitar which, when tuned properly, has a pitch equal to E329.6 Hz. The frequencies of the other notes along the fret scale are predetermined musical standards which the fret scale of the instrument is designed to produce when the string is depressed at the respective frets, thus altering the string's length and, therefore, its pitch.

In carrying out the tuning method of the invention, a tuning fork with a pitch equal to the pitch of a note along the open string (as determined by the fret scale of the instrument) is selected. In starting the tuning process, the tuning fork is excited to motion such, for example, as by striking it, and placed in contact with the string, as shown in FIGS. 2 and 4. At that position where the pitch of the tuning fork and the pitch of the string (as determined by the fret scale of the instrument) coincide, the tuning fork has the same effect as would be obtained by fretting the string (in this case, changing the speaking length of the string from the distance between the nut 20 and bridge 22 of the guitar, to the distance between the fifth fret 5 and bridge 22 of the instrument). If no such coincident point exists along the string due to a high pitch of the tuning fork, then the tuning fork is placed at a point where multiple integrals of its pitch (and always lower than its pitch) may be found on the fret scale, or at a point where the harmonic series of the string, and/or multiple integrals of the harmonic series of the string (and always lower than the pitch of the tuning fork) may be found on the fret scale. Since the tuning fork vibrates at A 440 Hz. at one end of a string with the proper tension, gauge, and speaking length to produce a pitch equal to A 440 Hz., sympathetic resonance occurs between the tuning fork and string, and the A 440 Hz. pitch amplified by the sound box 24 of the guitar becomes audible. The pitch of the open (unfretted) string is determined by several factors — string length, string gauge, and string tension. The overall string length and string gauge, of course, are constant. The string tension may be varied by adjusting the appropriate tuning key 26 associated with the particular string.

If the string tension is such as to provide that the open string is at its proper pitch, then the coincident point referred to above will also be at its proper pitch and the vibrating tuning fork will act to set up a node at the coincident point and sympathetic resonance will take place along the length of the string between the node at the coincident point and the bridge 22 of the instrument or along the ventral segments of the string between the nodes and bridge of the instrument and the pitch of the tuning fork will become audible. This indicates that the string is at its proper pitch or properly tuned.

If the string tension is not such that the open string is at its proper pitch, the sympathetic resonance referred to above will not take place and the pitch of the tuning fork will not become audible. This indicates that the string is not at its proper pitch, that is, it is not tuned and, therefore, must be adjusted.

It is the tension of the string that must be adjusted by use of the tuning key to adjust the pitch of the string. But first, it must be determined whether the tension should be increased or decreased.

In the tuning process, the vibrating tuning fork is slid slowly along the string to be tuned first in one direction and then in the other, always keeping it in contact with the string until sympathetic resonance takes place and the pitch of the tuning fork becomes audible. Thus the coincident point is determined for a string which is not at proper pitch. This coincident point may also be referred to as the vocal point.

Increasing string tension will increase the length of string required to produce sympathetic resonance with the pitch of the tuning fork and decreasing string tension will decrease the length of string required to produce sympathetic resonance with the pitch of the tuning fork. Therefore if the vocal point is between the tuning fret and the bridge 22 of the instrument, string tension must be increased. If the vocal point is between the tuning fret and the nut 20 of the instrument, string tension must be decreased.

Knowing now if string tension is to be increased or decreased, the tuning fork is again struck or otherwise excited to motion, and placed on the string as shown in FIG. 2 at the coincident point now known as the tuning fret. String tension is then adjusted as required until the vocal point is directly over the tuning fret (coincident point). When the adjustment of string tension accomplishes this, sympathetic resonance between the tuning fork and the string will take place at the tuning fret and the pitch of the tuning fork will become audible indicating that the open string is now properly tuned.

The tuning process on a guitar may be carried out as follows. The open pitch of the first string as shown in FIG. 2 on a standard six string guitar is most commonly designated as E 329.6 Hz. The fretted note at the fifth fret (counting from the nut toward the bridge) then is, according to the equal temperament tuning, A 440 Hz. Having chosen a tuning fork F known to have a pitch of A 440 Hz., it is struck or otherwise excited to motion, and placed on the string as shown in FIG. 2 at the fifth fret of the first string. The fifth fret of the first string is, in this case, the coincident point — the tuning fret. If sympathetic resonance takes place between the vibrating tuning fork and the string at the tuning fret this indicates that the string is at its proper pitch. If sympathetic resonance does not take place at the fifth fret, then the vibrating tuning fork is slid back and forth on the string as described above until the vocal point is located.

The tuning fork is excited to motion again and placed back at the tuning fret as seen in FIG. 2. String tension is adjusted until sympathetic resonance occurs between the tuning fork and the string at the tuning fret. The vocal point is now over the tuning fret (coincident point) as witnessed by the audible pitch of the tuning fork indicating that the fifth fret of the first string on the guitar is tuned to a pitch of 440 Hz. and that the open string is now tuned to E 329.6 Hz.

In order to tune the remaining strings of the guitar it is only necessary to know the tuning frets for each string as determined by the pitch of the tuning fork being used. In the case of the A 440 Hz. tuning fork, the tuning frets for each string would be as follows:

| | | | | | | |
|---|---|---|---|---|---|---|
| String Number | 6 | 5 | 4 | 3 | 2 | 1 |
| Tuning Fret | 5 | 12 | 7 | 2 | 10 | 5 |

In FIG. 3, the string shown is the third string of a classic guitar, which, when tuned properly, has a pitch equal to G 195.998 Hz. Pitches of fretted notes along the string are determined as in the description of FIG. 2 (both strings utilize the same fret scale).

FIG. 3 illustrates a situation in which the vibrating tuning fork is touched to the third string at that point where the pitch of the tuning fork and a lower multiple integral of that pitch along the string coincide. The speaking length of the string can now be said to be that distance between the second fret and the bridge of the instrument in this instance that speaking length will produce a pitch equal to A 220 Hz. The first subdivision of A 220 Hz. into its harmonic series is precisely one octave higher, or A 440 Hz. Thus, the string vibrates in sympathetic resonance in two ventral segments each with a speaking length of A 440 Hz. and setting up a node at the exact midway point between the second fret and the bridge. The sympathetic resonance of the two ventral segments is amplified (in this case by the sound box of the guitar), and the pitch of A 440 Hz. becomes audible.

The method of tuning herein disclosed may be used on a variety of fretted string instruments including, for example, guitar, electric guitar, banjo, mandolin, dulcimer and others.

The use of this method advantageously provides a highly accurate method of tuning and enables tuners to easily determine when two notes are identical in pitch. Furthermore it is usable on all fretted instruments. In addition, this method allows the tuner to determine if the pitch of the string is already too high, thus eliminating the danger of string breakage.

This method of tuning is highly advantageous because it may be readily understood and accurately used by the overwhelming majority of the people who play fretted instruments.

What is claimed is:

1. A method of tuning a fretted string instrument, such, for example, as a guitar comprising the following steps:
   - placing the end of a vibrating tuning fork of predetermined pitch in contact with a string to be tuned;
   - sliding the vibrating tuning fork along the string until the pitch of the vibrating tuning fork becomes audible;
   - adjusting the tension of the string being tuned until the pitch of the tuning fork becomes audible at the coincident point, that is, the point at which sympathetic resonance takes place when the string being tuned is at its proper pitch.

2. A method of tuning a fretted string instrument, such, for example, as a guitar comprising the steps of:
   - determining the pitch of an open string on the instrument;
   - selecting a tuning fork with a pitch higher than that of the open string to be tuned;
   - exciting the tuning fork into vibrating motion;
   - placing the tuning fork in contact with the string to be tuned at that position where the pitch of the tuning fork and the pitch of the string as determined by the fret scale of the instrument should coincide if the string is in tune;
   - sliding the vibrating tuning fork along the string and in contact therewith until the pitch of the tuning fork becomes audible;
   - re-exciting the tuning fork, if necessary, and then placing the tuning fork back at the coincident point (the tuning fret);
   - adjusting the tension of the string until the pitch of the fork becomes audible at the coincident point (the tuning fret) which indicates that the string is in tune.

3. A method of tuning a fretted string instrument using a tuning fork comprising the following steps:
   - exciting a tuning fork of predetermined pitch into vibrating motion;
   - placing the vibrating tuning fork in contact with the string to be tuned at a tuning fret for said string; and
   - adjusting the tension of said string until the pitch of the excited tuning fork becomes audible at the tuning fret.

4. The method of claim 3 including
   - initially sliding the vibrating tuning fork back and forth on said string to determine whether the tension of said string needs to be increased or decreased to bring it into tune.

5. The method of claim 3 wherein
   - the tuning fork is touched to the string at a point where the pitch of the tuning fork and a lower multiple of that pitch along the string coincide so that the string vibrates in two ventral segments.

6. The method of claim 3 wherein
   - the tuning fork is touched to the string at a point where the pitch of the tuning fork and the pitch of the fretted note along the string coincide.

* * * * *